US006832892B2

(12) United States Patent
Murphy et al.

(10) Patent No.: US 6,832,892 B2
(45) Date of Patent: Dec. 21, 2004

(54) SEALING OF STEAM TURBINE BUCKET HOOK LEAKAGES USING A BRAIDED ROPE SEAL

(75) Inventors: John Thomas Murphy, Niskayuna, NY (US); Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 10/316,102

(22) Filed: Dec. 11, 2002

(65) Prior Publication Data

US 2004/0115055 A1 Jun. 17, 2004

(51) Int. Cl.[7] ..... F01D 11/00

(52) U.S. Cl. ..... 415/174.2; 415/209.3; 416/218; 29/889.22

(58) Field of Search ..... 415/174.2, 170.1, 415/209.3, 209.2, 248, 200, 134–6; 416/218, 193 A, 248, 190; 29/889.22, 889.21

(56) References Cited

U.S. PATENT DOCUMENTS 4,022,545 A * 5/1977 Shank ..... 416/221
4,480,958 A * 11/1984 Schlechtweg ..... 416/220 R
4,725,200 A * 2/1988 Welhoelter ..... 416/221
5,129,783 A * 7/1992 Hayton ..... 415/209.3
5,358,262 A * 10/1994 Roberts ..... 277/652
5,544,873 A * 8/1996 Vickers et al. ..... 269/47
5,605,438 A 2/1997 Burdgick et al.
5,630,700 A * 5/1997 Olsen et al. ..... 415/134
6,126,389 A 10/2000 Burdgick
6,190,120 B1 2/2001 Thatcher et al.
6,331,096 B1 12/2001 Burdgick et al.
6,343,911 B1 2/2002 Burdgick
6,375,415 B1 4/2002 Burdgick
6,375,429 B1 * 4/2002 Halila et al. ..... 416/193 A
6,386,825 B1 5/2002 Burdgick
6,390,769 B1 5/2002 Burdgick et al.
6,398,489 B1 6/2002 Burdgick et al.
6,402,466 B1 6/2002 Burdgick et al.
6,413,040 B1 7/2002 Yu et al.
6,418,618 B1 7/2002 Burdgick
6,419,445 B1 7/2002 Burdgick
6,422,810 B1 7/2002 Burdgick et al.
6,435,814 B1 8/2002 Yu et al.
6,446,979 B1 * 9/2002 Steinetz et al. ..... 277/630
6,453,557 B1 9/2002 Burdgick
6,464,453 B2 * 10/2002 Toborg et al. ..... 415/115
6,464,456 B2 * 10/2002 Darolia et al. ..... 415/134

* cited by examiner

*Primary Examiner*—Edward K. Look
*Assistant Examiner*—James M. McAleenan
(74) *Attorney, Agent, or Firm*—Nixon & Vanderhye P.C.

(57) ABSTRACT

A steam turbine includes a rotor supporting a plurality of turbine buckets. The rotor has shaped grooves for receiving a complementary-shaped bucket hook formed on an end of each of the turbine buckets. A rope seal is disposed in each interface between the bucket hooks and the shaped grooves, respectively. The rope seal serves to seal a leakage path that may exist over the bucket hooks between the buckets and respective rotor grooves.

15 Claims, 2 Drawing Sheets

SEALING OF STEAM TURBINE BUCKET HOOK LEAKAGES USING A BRAIDED ROPE SEAL

BACKGROUND OF THE INVENTION

The present invention relates to turbine buckets of steam turbines and, more particularly, to sealing of steam turbine bucket hook leakages using a braided rope seal.

Within a steam turbine, buckets (airfoil, platform and dovetail) turn the flow while extracting energy from steam. In a reaction-style turbine design, these individual buckets are slid into a circumferential groove around the turbine rotor. There exists a leakage circuit around the bucket aft (downstream) hook to the rotor axial load surface. This leakage bypasses the bucket, and therefore the energy is not extracted from the steam. This over-the-hook leakage in this area may be significant due to the assembly issues and bucket loading issues that could cause the bucket to lift off of this axial load surface that is being sealed.

BRIEF DESCRIPTION OF THE INVENTION

In an exemplary embodiment of the invention, a steam turbine includes a rotor supporting a plurality of turbine buckets. The rotor has shaped grooves for receiving a complementary-shaped bucket hook formed on an end of each of the turbine buckets. A rope seal is disposed in each interface between the bucket hooks and the shaped grooves, respectively.

In another exemplary embodiment of the invention, a method of constructing a steam turbine is provided, where the steam turbine includes a plurality of buckets with bucket hooks and a rotor with grooves shaped corresponding to the bucket hooks. The method comprises the steps of inserting a rope seal in each of the rotor grooves; and securing the buckets in the rotor grooves, respectively, via the bucket hooks, whereby the rope seal is disposed in each interface between the bucket hooks and the grooves.

In still another exemplary embodiment of the invention, a rotor assembly for a steam turbine includes a plurality of shaped grooves for receiving a corresponding plurality of turbine buckets via complementary-shaped bucket hooks formed on an end of each of the turbine buckets. The rope seal is disposed in each interface between the bucket hooks and the shaped grooves, respectively.

DETAILED DESCRIPTION OF THE INVENTION

In steam turbine design, it is important to seal up as many leakage paths as possible within the turbine secondary (leakage) flow circuits. Each stage of a steam turbine consists of a rotor and bucket stage following a stage of nozzles (airfoils). In one turbine design, the buckets, including airfoils and dovetails, are slid into circumferential hooks (grooves) on the rotor. There is a leakage path that exists over the bucket hooks between the bucket and the rotor groove. This leakage is caused by higher pressure steam in the forward cavity (upstream cavity). There is a pressure drop across the bucket that causes this pressure differential.

This leakage, if not accounted for, will cause increased efficiency losses. Such hooks typically exist in the high pressure (HP) and intermediate pressure (IP) steam turbine sections.

Figure 1:
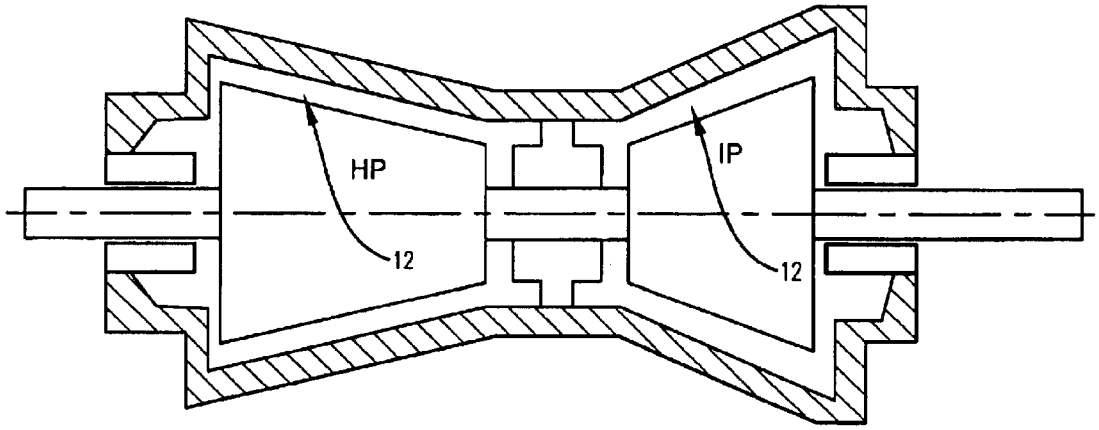
FIG. 1 is a side view of a typical HP/IP steam turbine.

FIG. 1 illustrates a side view of a typical HP/IP steam turbine. The bucket areas are designated by reference numeral 12.

By the present invention, it has been discovered that a rope seal 10 such as a braided rope seal can be placed at an interface between the bucket dovetail 14 and an axial load surface 16 of a groove 18 in the rotor for the purpose of reducing leakage flow across the interface. See FIG. 2. The seal results in an efficiency increase of the stage, adding up to an increase in total machine performance. The seal is preferably suited for reaction turbine bucket designs, but can also be retrofitted into existing technology that uses a circumferential bucket hook assembly. The performance payoff would typically be higher for the higher reaction type designs due to the increased pressure taken across each bucket stage.

Figure 2:
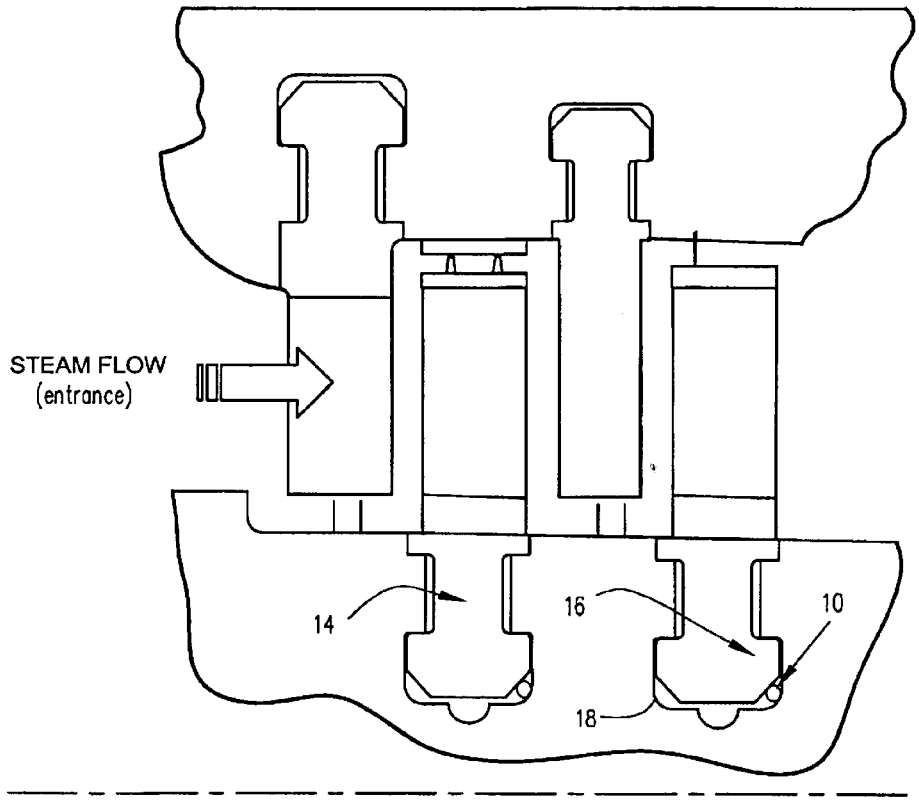
FIG. 2 is a schematic illustration of a bucket and rotor cross section incorporating the rope seal of the present invention.

With continued reference to FIG. 2, the sealing design uses a circumferential braided rope seal 10 to seal the interface between the bucket segment (dovetail) aft (downstream) hook 14 and the axially loaded groove 16, 18 in the rotor. The seal is typically used where the buckets are individual or "ganged" segments that are slid into a circumferential groove in the rotor structure.

Preferably, the braided rope seal 10 is formed of a braided metal sheathing surrounding a composite matrix such as ceramic. This gives the seal 10 flexibility and high temperature resistance while being able to retain some resiliency. The typical rope seal preferably has between $1/16^{th}$–$3/16^{th}$ inch diameter.

In constructing the rotor assembly, the rope seal 10 is inserted in the rotor groove, and the buckets are secured in one-by-one around the rotor. The pressure differential across the bucket stage would cause the rope seal 10 to deform into the gap between the bucket hook 14 and the rotor groove 18. As a result, the "over-the-hook" leakage is significantly reduced at this location. Preferably, the rope seal 10 is formed of a material such that once the seal has been put through at least one engine operating cycle, the seal should deform sufficiently into the gap and "permanently" stay in place. It has been shown through bench testing that this type of seal is much better at sealing leakages between components than existing metal-to-metal contact.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A steam turbine comprising a rotor supporting a plurality of turbine buckets, the rotor including shaped grooves for receiving a complementary-shaped bucket hook formed on an end of each of the turbine buckets, wherein a rope seal is disposed adjacent a distal end of the turbine buckets in each interface between the bucket hooks and the shaped grooves, respectively.

2. A steam turbine according to claim 1, wherein the rope seal comprises braided metal sheathing surrounding a composite matrix.

3. A steam turbine according to claim 2, wherein the composite matrix is ceramic.

4. A steam turbine according to claim 1, wherein the rope seal has a diameter between $1/16^{th}$ inch and $3/16^{th}$ inch.

5. A steam turbine according to claim 1, wherein the rope seal is formed of a material such that after the seal is put through at least one engine operating cycle, the seal will deform into the interface.

6. A steam turbine according to claim 1, wherein the rope seal is disposed in each interface between the bucket hooks and an axially loaded surface of the shaped grooves, respectively.

7. A steam turbine according to claim 1, wherein the rope seal is a braided rope seal.

8. A method of constructing a steam turbine including a plurality of buckets with bucket hooks and a rotor with grooves shaped corresponding to the bucket hooks, the method comprising:

inserting a rope seal in each of the rotor grooves; and securing the buckets in the rotor grooves, respectively, via the bucket hooks, whereby the rope seal is disposed adjacent a distal end of the buckets in each interface between the bucket hooks and the grooves.

9. A rotor assembly for a steam turbine including a plurality of shaped grooves for receiving a corresponding plurality of turbine buckets via complementary-shaped bucket hooks formed on an end of each of the turbine buckets, wherein a rope seal is disposed adjacent a distal end of the turbine buckets in each interface between the bucket hooks and the shaped grooves, respectively.

10. A rotor assembly according to claim 9, wherein the rope seal comprises braided metal sheathing surrounding a composite matrix.

11. A rotor assembly according to claim 10, wherein the composite matrix is ceramic.

12. A rotor assembly according to claim 9, wherein the rope seal has a diameter between $1/16^{th}$ inch and $3/16^{th}$ inch.

13. A rotor assembly according to claim 9, wherein the rope seal is formed of a material such that after the seal is put through at least one engine operating cycle, the seal will deform into the interface.

14. A rotor assembly according to claim 9, wherein the rope seal is disposed in each interface between the bucket hooks and an axially loaded surface of the shaped grooves, respectively.

15. A rotor assembly according to claim 9, wherein the rope seal is a braided rope seal.

* * * * *